United States Patent [19]

Hurskainen

[11] Patent Number: 4,459,835

[45] Date of Patent: Jul. 17, 1984

[54] MULTI-FUNCTION LOCK

[75] Inventor: Oiva Hurskainen, Joensuu, Finland

[73] Assignee: Oy Wartsila Ab, Helsinki, Finland

[21] Appl. No.: 359,847

[22] Filed: Mar. 19, 1982

[30] Foreign Application Priority Data

Mar. 25, 1981 [FI] Finland ..... 810912

[51] Int. Cl.[3] ..... E05B 55/04; E05B 65/06

[52] U.S. Cl. ..... 170/486; 70/134

[58] Field of Search ..... 70/128, 133, 134, 476, 70/477, 483, 485, 486

[56] References Cited

U.S. PATENT DOCUMENTS

| | | | |
|---|---|---|---|
| 246,145 | 8/1881 | Keil | 70/486 |
| 621,874 | 3/1899 | Voight | 70/486 |
| 1,606,710 | 11/1926 | Lawrence | 70/486 |

*Primary Examiner*—Robert L. Wolfe

*Attorney, Agent, or Firm*—McAulay, Fields, Fisher, Goldstein & Nissen

[57] ABSTRACT

A door lock comprises a reciprocatingly movable lock bolt and means for locking the lock bolt in a protruding position, for keeping the lock bolt in a withdrawn position and for operating the lock bolt either with a handle or the like or with a key operated mechanism. There is also a lock function selector for selecting a desired type of functional capacity for the lock. The lock function selector has three different setting positions, of which each determines a specific type of functional capacity for the lock. There is a setting member, preferably in a hidden position when the lock is mounted in a door, by means of which setting member the setting of the lock function selector can be restricted in order to further determine the types of function obtainable by the lock.

15 Claims, 4 Drawing Figures

11
10
1
5
4
7
12
17
6
24
16
13
6
9
18
22
15
14
21
20
8
2
23
19
3

11
12
10
4
5
1
7
17
13
6
16
6
9
24
18
15
21
14
20
22
8
2
23
19

MULTI-FUNCTION LOCK

FIELD OF THE INVENTION

The invention relates to a door lock comprising a lock bolt and means for locking the lock bolt in a protruding position, for keeping the lock bolt in a withdrawn position and for operating the lock bolt with a handle or the like as well as with a key operated mechanism, and a lock function selector for selecting a desired type of function for the lock.

A door lock has to meet different requirements in accordance with its intended application. The functional requirements can be divided into three main groups typical for fire-doors, staircase doors and office doors, respectively.

A typical requirement for a fire-door lock is, firstly, that the lock bolt can be dead-locked in its protruding position and, secondly, that the bolt cannot be locked to remain in its withdrawn position. Further, the lock should have a so called day-time operation setting and a night-time operation setting. Day-time operation means that opening of the door, at least from one side, is possible just by means of a handle or the like, that is, without a key. Night-time operation means that the lock bolt is dead-locked, that is, mechanically locked in its protruding position and that the door can be opened by means of a key only.

Staircase door operation means that anybody must be able to pass the door from its inside without a key. Since a staircase door is usually not provided with a handle at the outside, a further requirement is that the door bolt during day-time operation can stationary be locked in its withdrawn position.

Office door function requires a complete range of operation types, that is, the lock must include the full operational capacity of a fire-door as well as of a staircase door.

The known art provides no solution to the problem of how all the basic operation types of a door lock could be obtained, in an uncomplicated and economic way, in a single basic lock construction, and further so, that the final functional properties of the lock can be activated when the actual application of the lock is known. The known art usually uses different lock constructions for each basic type of application, but this means that a great number of different lock models has to be produced and stored, which is clearly undesirable.

OBJECTS AND FEATURES OF THE INVENTION

The main object of the invention is to provide a single lock model which can be given the desired functional properties by operating, when the lock is installed, an uncomplicated setting member to meet thereby the requirements of the actual application. A further object is to provide a lock, in which the functional properties can be altered, if the lock is transferred to a new application. The invention is characterized in that the function selector of the lock has three different operating positions each of which determines a specific type of function for the lock, and that, in addition, there is a setting member, preferably in a hidden position when the lock is mounted for normal use in a door, by means of which setting member the movement of the lock function selector can be restricted in order to further determine the types of operation obtainable by the lock.

In a preferred embodiment of the invention, the function selector of the lock has three operational positions one after another in its moving direction. The movement of the selector can be restricted by means of the setting member so that either one of the extreme positions of the selector can be excluded from use by proper setting of the setting member. This makes it possible to selectively exclude some lock functions which could cause confusion or malfunction in certain applications, but are important in other applications.

The lock function selector is preferably arranged to be operable when the door is open and not accessible for operation when the door is closed. Traditionally this kind of selector includes a knob or the like, which is operable from the edge side of the door. On the other hand, the setting member of the lock is preferably arranged at the side of the lock casing so that, in mortise locks, it is in a hidden position,. In a surface lock, the setting member can be in a hidden position at the side of the lock facing the door.

If unauthorized alteration of the setting of the lock function selector is to be prevented, a locking member can easily be arranged in the lock, so that the selected position of the function selector can temporarily be locked. This is at the best arranged by means of a locking screw, which is operable only by means of a special tool.

BRIEF DESCRIPTION OF THE DRAWINGS

In the following, the invention is described more in detail with reference to the attached drawing, in which

In the drawing, reference numeral 1 refers to a lock casing, 2 to a lock bolt, 3 to the central opening of a handle follower and 4 to a connection recess receiving the torque transmitting tongue of a cylinder lock mechanism. Such a mechanism connected to recess 4 operates a turntable disc 5, which by means of knobs 6 lifts a guided plate 7. A lever 8 is pivotally mounted on a stationary shaft 9 and connected by means of horizontally elongated guiding means, for instance, a pin in an elongated hole, to plate 7. The lower end of lever 8 is engaged in an opening in lock bolt 2 as shown. In FIG. 1, lever 8 is in such a position, that bolt 2 is dead-locked in its protruding position. Lever 8 can reach this position only if the function selector of the lock, generally indicated by 10, is in its uppermost position. Function selector 10 can be manually operated from the edge side of the door and moved to different positions by operating its upper end visible in an opening 12 in the forend plate 11 of the lock. The vertical movement of function selector 10 can be restricted by means of a setting member 13, which is shown in its intermediate position in FIG. 1. In this position setting member 13 allows function selector 10 to be moved all over its full range, which is limited by the end portions of opening 12. Function selector 10 has an elongated opening 20 receiving the shaft of a stationary locking screw 14. The position of function selector 10 can temporarily be locked by tightening locking screw 14 through a small opening 15 in forend plate 11. Locking screw 14 has preferably an inside hexagonal opening, in which a hexagonal bar can be inserted for operating the screw. Locking screw 14 is threaded in a hole 22 in a member 21 fastened to side wall 23 of lock casing 1.

FIG. 2 shows how setting member 13 restricts the movements of function selector 10. Setting member 13 is turned by means of a shaft 16 provided with a slotted head for turning and journalled in the not shown side wall of lock casing 1, the one opposite to side wall 23. Setting member 13 can be turned into three different positions, of which the intermediate one is shown in FIG. 2 by full lines, whereas the two other functional positions are shown by dash-and-dot lines of different character. The two other positions are reached by turning the setting member 90° to the left and to the right. Setting member 13 is movable in a recess 24 cut in function selector 10. The recess has an upper stop face 17 and a lower stop face 18.

If function selector 10 is moved to its uppermost position, stop faces 17 and 18 take the positions A1 and A2, respectively. In the lowermost position of function selector 10, the stop faces take the positions C1 and C2. As shown in FIG. 2, the effect of turning setting member 13 so that its points upwards is that selector 10 cannot reach its lowermost position, as the upper stop face 17 cannot reach position C1. Correspondingly, member 13 being turned to point downwards, selector 10 cannot be moved to its uppermost position, as lower stop face 18 cannot reach position A2. When setting member 13 is in its intermediate position, selector 10 can be moved to any of its functional positions.

In FIG. 3, setting member 13 is turned to point upwards and function selector 10 can be set to its uppermost and intermediate positions only. Selector 10 is shown in its intermediate position which corresponds to so-called day-time function of a fire-door lock. The lock bolt cannot be dead-locked in its protruding position, because the lower end of selector 10 will prevent lever 8 from reaching its dead-locking position. So-called night-time function requires dead-locking and this is obtained by moving selector 10 to this uppermost position, which is the position shown in FIG. 1. In order to prevent unauthorized setting of selctor 10 into its uppermost position, its movements can temporarily be locked by locking screw 14, as already described.

Figure 1:
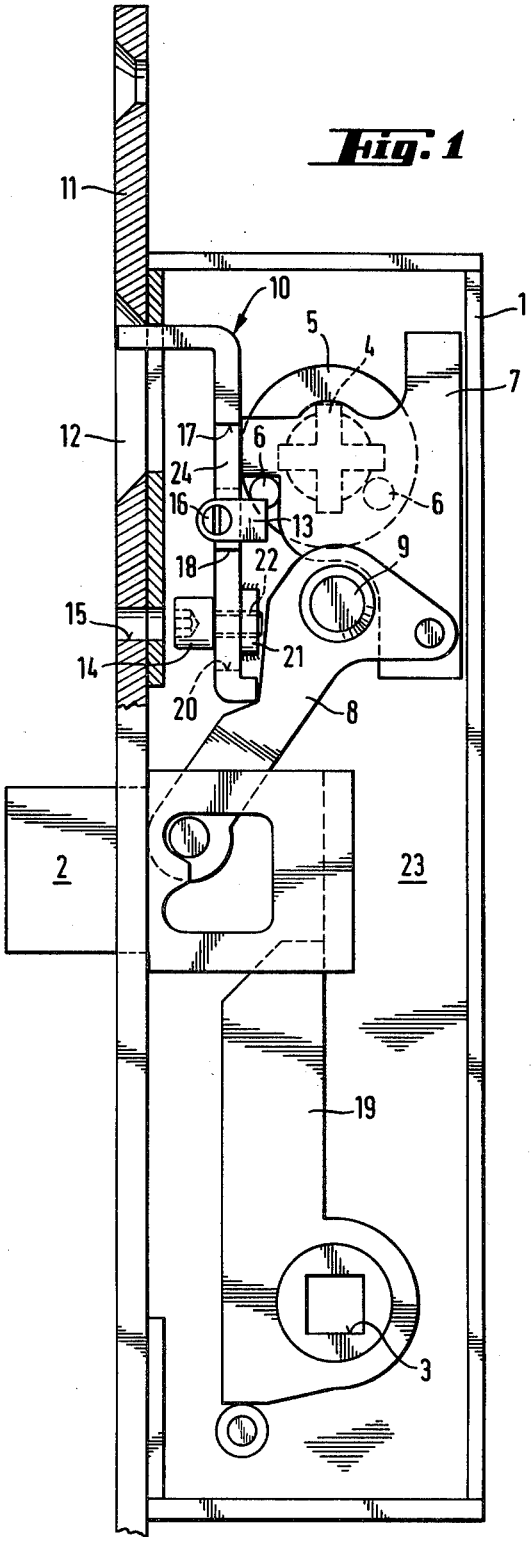
FIG. 1 shows a side view of an opened lock casing.
Figure 2:
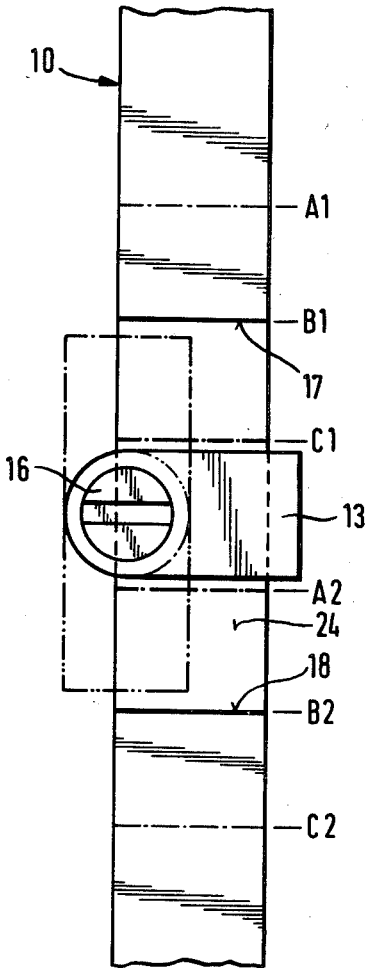
FIG. 2 shows schematically the function of the setting member.
Figure 3:
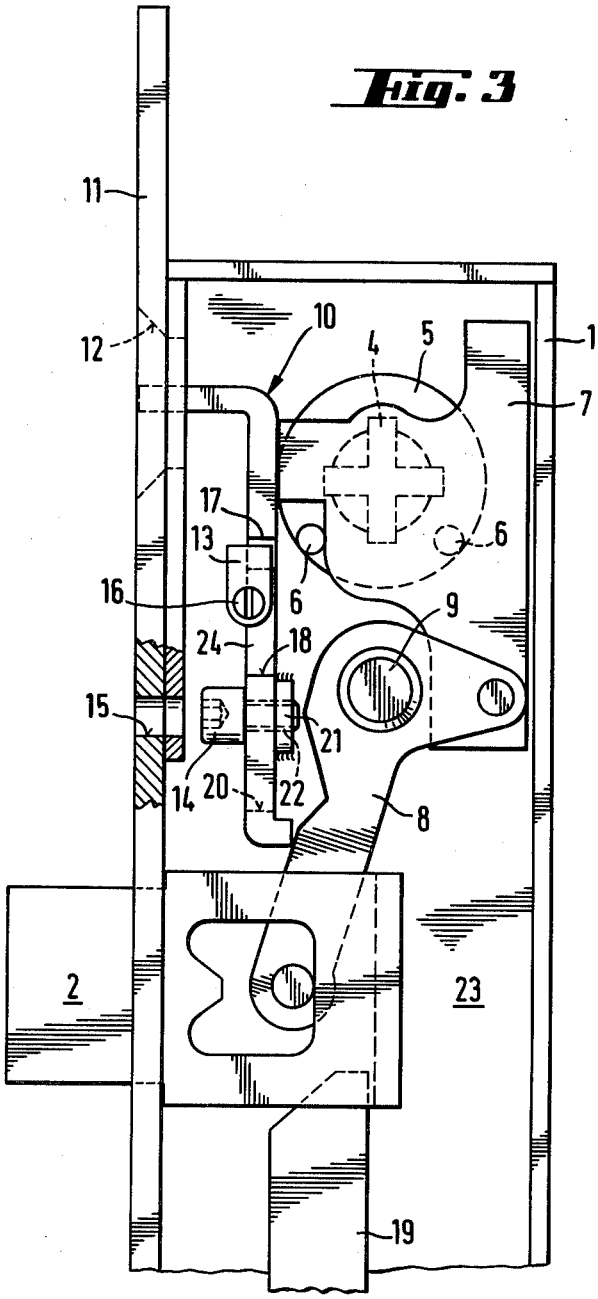
FIG. 3 shows a lock according to FIG. 1 arranged to operate in the mode of a fire-door lock.

When setting member 13, as shown in FIG. 1, is in its intermediate position, the lock is usable as an office lock, in which all the functional possibilities should be at hand. Selector 10 being in its intermediate position, as shown in FIG. 3, the lock has day-time function and can be opened by a handle or the like, which by means of a force transmitting lever 19 directly acts on bolt 2.

Figure 4:
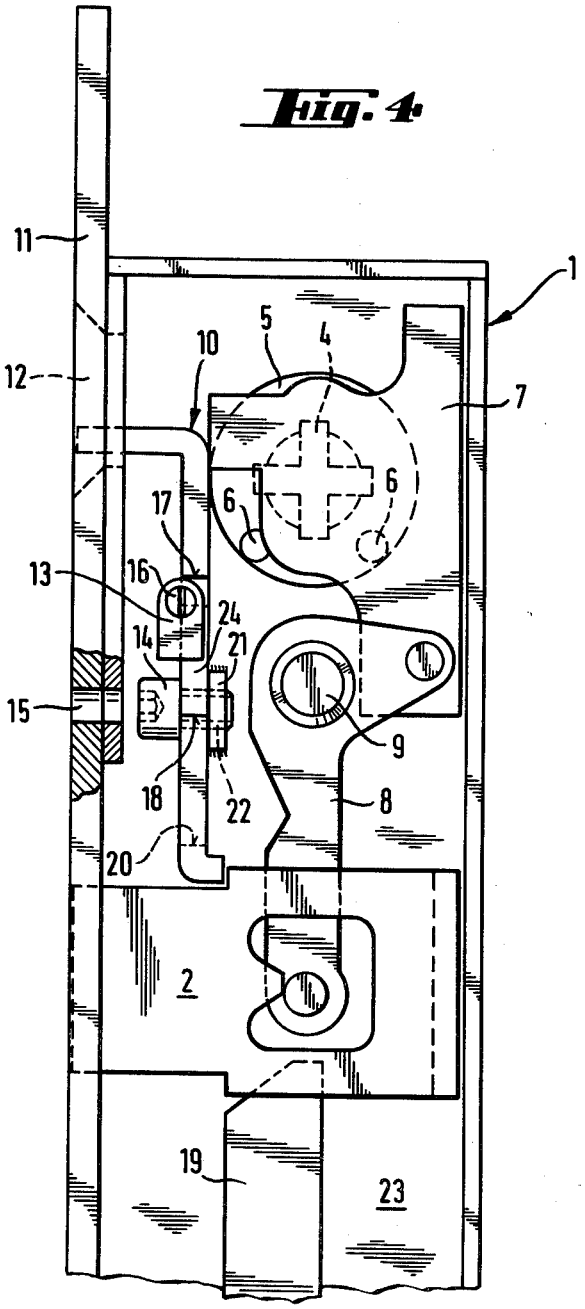
FIG. 4 shows a lock according to FIGS. 1 and 3 arranged to operate in the mode of a staircase door lock.

In FIG. 4, setting member 13 points downwards, which means that the lock has the function of a staircase door lock. Selector 10 is in its lowermost position and its lower end keeps bolt 2 in a withdrawn position inside lock casing 1. By moving selector 10 to its intermediate position, bolt 2 is freed and the lock is operable from the inside of the door by means of a handle and from the outside of the door by means of a key. Selector 10 is in this case prevented from reaching its uppermost position, because in a staircase door lock, dead-locking of the bolt in its outer position so that the bolt is not operable by means of a handle from the inside of the door, is not permitted.

The invention is not limited to the embodiments shown, but several modifications thereof are feasible within the scope of the attached claims.

I claim:

1. A door lock comprising a lock bolt reciprocatingly movable between a protruding locking position and a retracted inactive position, means for locking said lock bolts in its protruding position, means for keeping said lock bolt in its retracted position, means for operating said lock bolt from a handle or the like as well as by means of a key operated mechanism, and a lock function selector for setting a desired lock function, said lock selector having three different setting positions of which each determines a specific type of lock function, a setting restricting member, by means of which the setting of said lock function selector is restrictable to exclude at least one of its lock function settings.

2. A door lock according to claim 1, in which said lock function selector has three different setting positions arranged one after the other in the movement direction of the lock function selector, and in which said setting restricting member is adjustable for restricting the range of movement of said lock function selector, so that either one of the extreme positions of said three setting positions of the lock function selector is excludable from use by proper setting of said setting restricting member.

3. A door lock according to claim 1, in which said lock function selector has a member operable from the edge side of a door in which said lock is mounted, said setting restricting member being a turnable member operable from another side of the lock.

4. A door lock according to claim 3, in which there is a locking means for temporary locking of the setting of said lock function selector.

5. A door lock according to claim 2, in which said lock function selector has a knob operable from the edge side of a door in which said lock is mounted, said setting restricting member being a turnable member operable from another said of the lock.

6. A door lock according to claim 5, in which there is a locking means for temporary locking of the setting of said lock function selector.

7. A door lock according to claim 6, wherein said locking means consist of a locking screw.

8. A door lock according to claim 1, wherein said setting restricting member is mounted in a hidden position on said lock when said lock is in use on a door.

9. A door lock according to claim 1, in which there is a locking means for temporary locking of the setting of said lock function selector.

10. A door lock according to claim 9, wherein said locking means consist of a locking screw.

11. A door lock comprising a lock bolt reciprocatingly movable between a protruding locking position and a withdrawn inactive position, means for locking said lock bolt in its protruding position, means for keeping said lock bolt in its withdrawn position, means for operating said lock bolt from a handle or the like as well as by means of a key operated mechanism, and a lock function selector for selecting a desired type of functional capacity for the lock, said lock function selector having three different setting positions of which each determines a specific type of functional capacity for the lock, a setting member, preferably in a hidden position when the lock is mounted for normal use in or on a door, by means of which setting member the setting of said lock function selector can be restricted in order further to determine the types of function obtainable by the lock, said lock function selector having three different setting positions arranged one after the other in the movement direction of the lock function selector, and a setting member adjustable for restricting the range of movement of said lock function selector, so that either one of the extreme positions of said three setting positions of the lock function selector can be excluded from use by means of a proper setting of said setting element.

12. A door lock according to claim 11, in which said lock function selector has a knob or the like arranged to be operable from the edge side of a door or the like in which said lock is mounted, said setting element being a turntable member operable from another side of the lock.

13. A door lock according to claim 12, in which there is a locking means for temporary locking of the setting of said lock function selector.

14. A door lock comprising a lock bolt reciprocatingly movable between a protruding locking position and a withdrawn inactive position, means for locking said lock bolt in its protruding position, means for keeping said lock bolt in its withdrawn position, means for operating said lock bolt from a handle or the like as well as by means of a key operated mechanism, and a lock function selector for selecting a desired type of functional capacity of the lock, said lock function selector having three different setting positions of which each determines a specific type of functional capacity for the lock, a setting member, preferably in a hidden position when the lock is mounted for normal use in or on a door, by means of which setting member the setting of said lock function selector can be restricted in order further to determine the types of function obtainable by the lock, said lock function selector having a knob or the like arranged to be operable from the edge side of a door or the like in which said lock is mounted, said setting element being a turnable member operable from another side of the lock.

15. A door lock according to claim 14, in which there is a locking means for temporary locking of the setting of said lock function selector.

* * * * *